US006485338B1

(12) United States Patent
Wu

(10) Patent No.: US 6,485,338 B1
(45) Date of Patent: Nov. 26, 2002

(54) COMPRESSION CONNECTOR

(75) Inventor: Jerry Wu, Pan-Chiao (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/955,279

(22) Filed: Sep. 10, 2001

(51) Int. Cl.[7] ..... H01R 4/48
(52) U.S. Cl. ..... 439/862; 439/495; 439/490
(58) Field of Search ..... 439/862, 495, 439/74, 76.1, 66, 620, 490

(56) References Cited

U.S. PATENT DOCUMENTS 6,022,248 A * 2/2000 Wu et al. ..... 439/862
6,302,727 B1 * 10/2001 Fedorjaka ..... 439/862
6,315,620 B1 * 11/2001 Moir et al. ..... 439/862
6,379,176 B1 * 4/2002 Ohsawa et al. ..... 439/495

* cited by examiner

*Primary Examiner*—Hien Vu
(74) *Attorney, Agent, or Firm*—WeiTe Chung

(57) ABSTRACT

A compression connector (1) comprises a base (2), a cover (3) assembled on the base, a PCB (9) and a plurality of terminals (5). The base comprises a plurality of walls (271) with a plurality of grooves (272) therebetween. A plurality of pairs of slots (273) is located on opposite sides of and in communication with the grooves. Each terminal comprises a contacting portion (54) contacting an FPC, a mounting portion (521) received in the groove, and a tail portion (51) contacting the PCB. The mounting portion comprises two pairs of barbs (521) engaging with a corresponding pair of slots.

6 Claims, 6 Drawing Sheets

2

3

COMPRESSION CONNECTOR

BACKGROUND OF THE INVENTION

1. Field of the Invention

The present invention relates to a compression connector of a computer printer for controlling ink ejection operation of an ink cartridge, and particularly to a compression connector which securely retains terminals therein.

2. Description of Related Art

Computer printers are classified into dot matrix printers, laser printers and ink-jet printers. An ink-jet printer comprises an ink cartridge, usually disposable, for preservation of ink, and an ink jetting head for depositing ink on a medium to be printed. A control circuit connected to the ink cartridge and the ink jetting head controls the printing operation. The connection between parts of the ink-jet printer may be provided by a flexible printed circuit (FPC) board, or a wire harness assembly. Thus, a connector is required to connect the FPC or wires to the ink cartridge or other related components. As is disclosed in U.S. Pat. No. 6,099,356, a conventional ink cartridge connector, known as a compression connector, comprises a base, a cover assembled upon the cover, and a plurality of terminals retained in the base. However, the terminals are not securely retained in the base in a front-to-back direction.

Hence, an improved compression connector is required to overcome the disadvantages of the conventional compression connector.

SUMMARY OF THE INVENTION

Accordingly, the object of the present invention is to provide a compression connector which securely retains terminals therein.

In order to achieve the object set forth, a compression connector for mating with an FPC in accordance with the present invention comprises a bottom base, a top cover assembled upon the bottom base, a built-in PCB, and a plurality of terminals. The bottom base comprises a terminal-receiving portion comprising a plurality of block walls. Every two block walls define a receiving groove therebetween. A pair of opposite mounting slots is provided on opposite sides of and in communication with each receiving groove. The top cover comprises a receiving concavity for receiving an upper edge of the PCB. Each terminal comprises a contacting portion for contacting the FPC, a mounting portion substantially received in the receiving groove, a tail portion connected with the PCB, and a preloading portion extending horizontally from an end of the contacting portion. The mounting portion comprises two pairs of barbs interferentially engaged with the mounting slots to securely retain the terminal in the receiving groove.

Other objects, advantages and novel features of the invention will become more apparent from the following detailed description when taken in conjunction with the accompanying drawings.

DETAILED DESCRIPTION OF THE INVENTION

Figure 1:
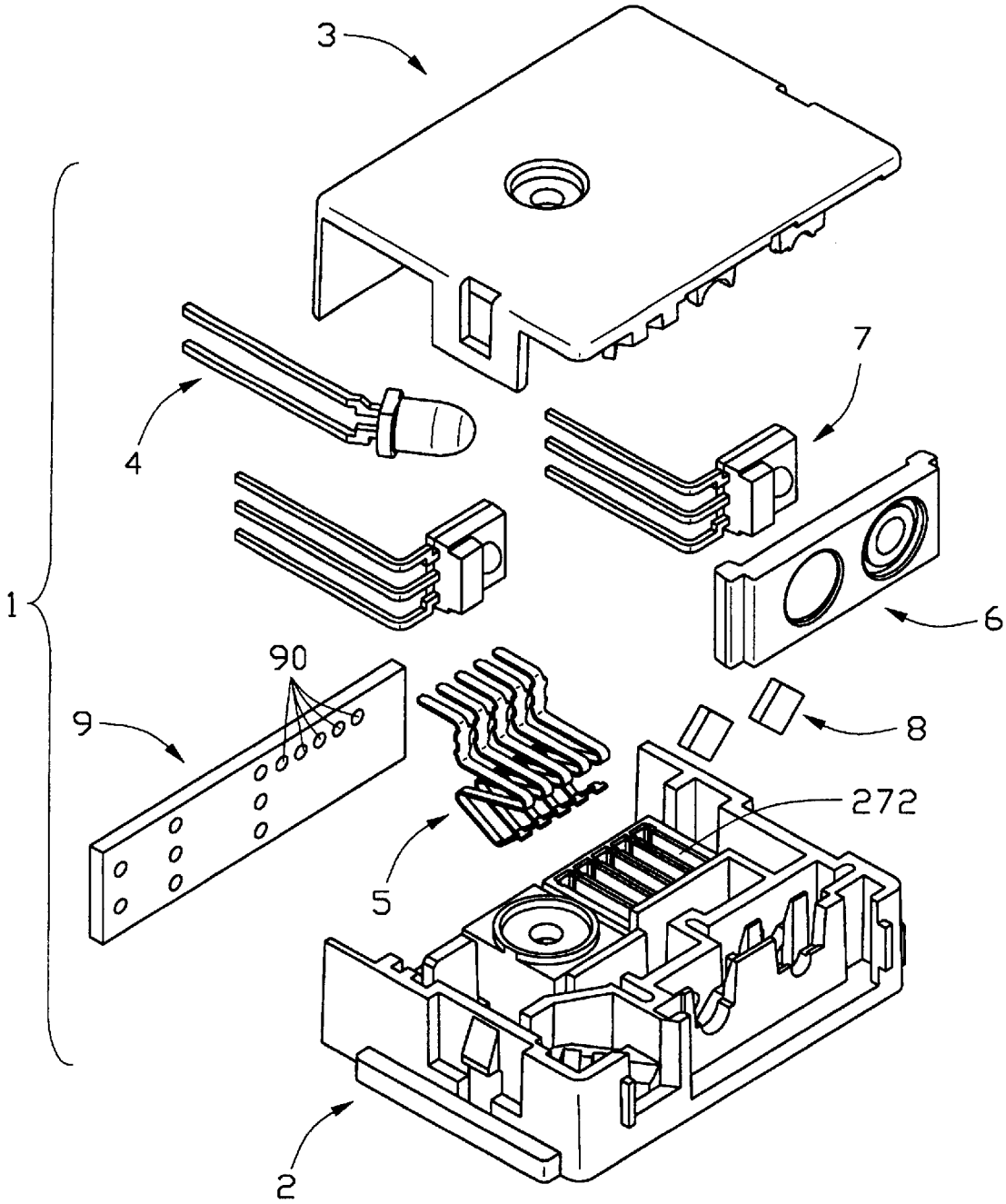
FIG. 1 is a perspective, exploded view of a compression connector of the present invention.

Reference will now be made to the drawing figures to describe the present invention in detail.

Referring to FIG. 1, a compression connector 1 in accordance with the present invention comprises a bottom base 2, a top cover 3 assembled upon the base 2, an LED (Light Emitting Diode) 4, a plurality of terminals 5, a lens 6, a pair of fiber optical components 7, a pair of filters 8 and a built-in PCB (Printed Circuit Board) 9.

Figure 2:
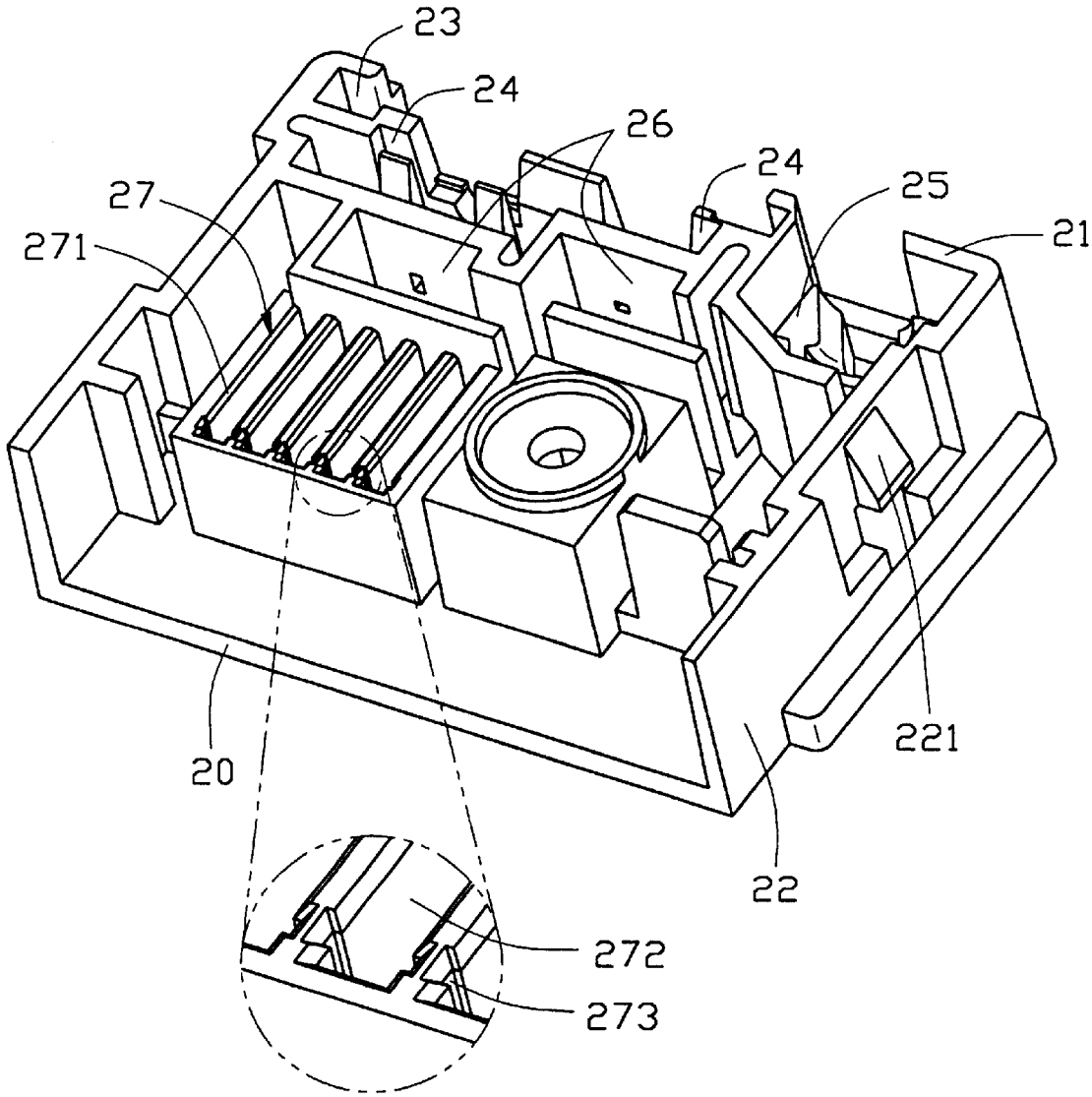
FIG. 2 is a rear, perspective view of a base of the compression connector in FIG. 1.

Referring to FIG. 2, the bottom base 2 comprises a bottom wall 20, a front wall 21, and a pair of side walls 22. The bottom base 2 defines an elongate first receiving channel 23 behind the front wall 21 for receiving the lens 6, a pair of second receiving channels 24 behind the first receiving channel 23 for receiving corresponding filters 8, a first receiving room 25 proximate to one side wall 22 for receiving the LED 4, and a pair of second receiving rooms 26 behind the second receiving channels 24 for receiving the fiber optical components 7. The bottom base 2 comprises a terminal-receiving portion 27 at a rear end thereof. The terminal-receiving portion 27 comprises a plurality of longitudinal block walls 271. Every two adjacent block walls 271 define an elongate receiving groove 272 therebetween for receiving a corresponding terminal 5. A pair of opposite mounting slots 273 is provided on opposite sides of and in communication with each receiving groove 272. Each mounting slot 273 extends a predetermined distance (best shown in FIG. 6). The bottom wall 20 defines a plurality of through holes 201 (FIG. 5) communicating with the receiving grooves 272 for projection of the terminals 5. Each side wall 22 of the bottom base 2 comprises a wedge-shaped protrusion 221.

Figure 3:
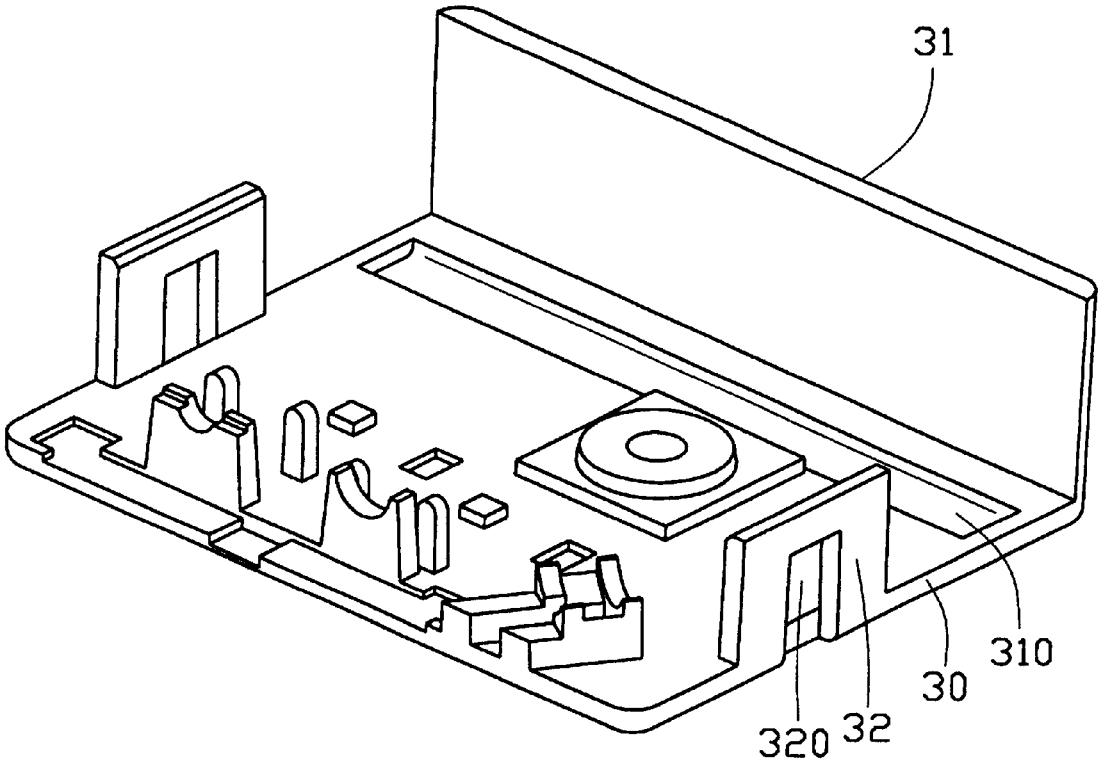
FIG. 3 is a bottom, perspective view a cover of the compression connector in FIG. 1.

Referring to FIG. 3, the top cover 3 comprises a top wall 30, a rear wall 31 extending downwardly from a rear edge of the top wall 30, and a pair of ears 32 extending downwardly from each transverse edge of the top wall 30. The top wall 30 defines a receiving concavity 310 for receiving an upper edge of the PCB 9. Each of the ears 32 defines a slot 320 for engaging with the protrusion 221 of the bottom base 2 to securely retain the top cover 3 on the bottom base 2.

Figure 4:
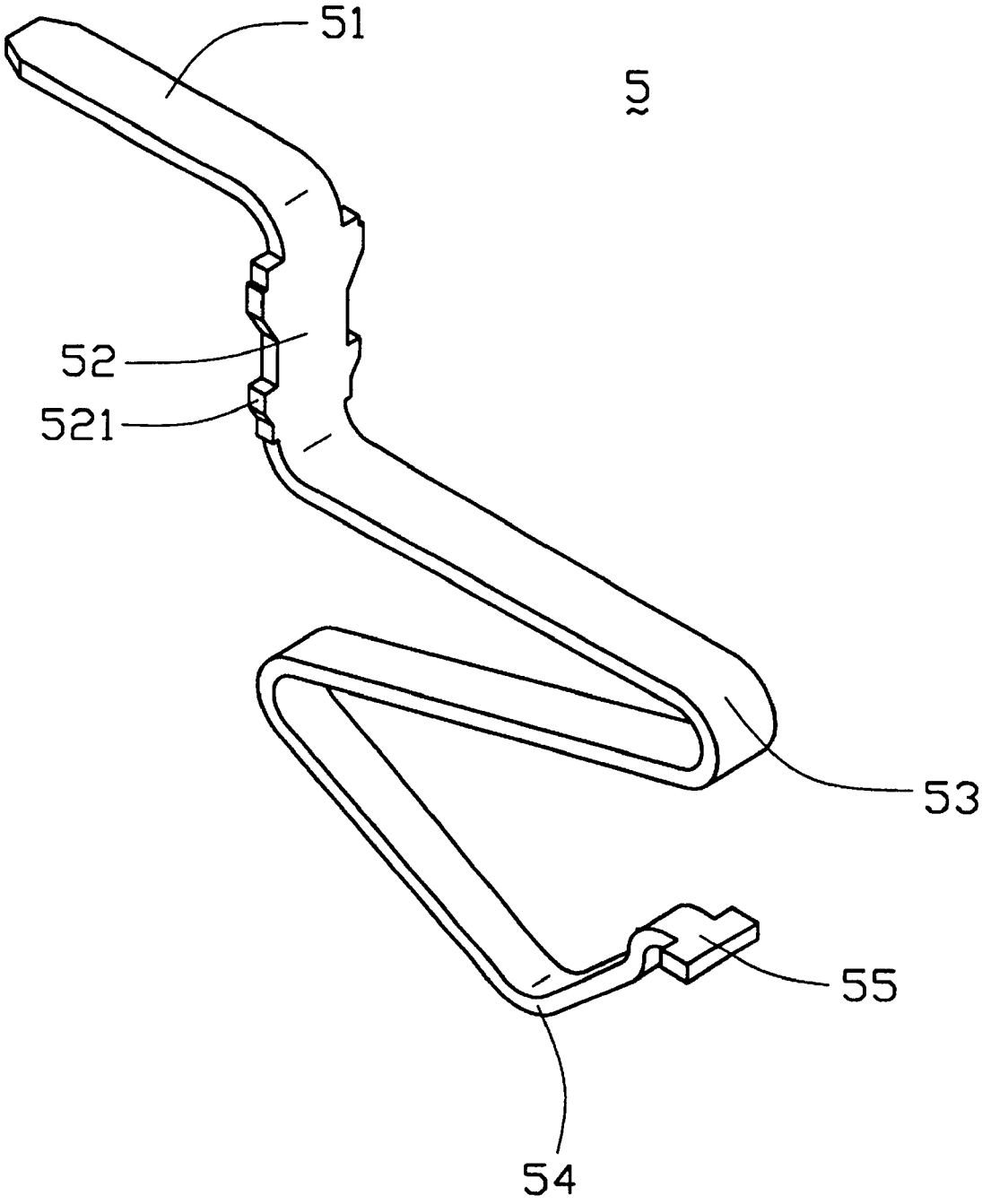
FIG. 4 is a perspective view of a terminal of the compression connector in FIG. 1.

Referring to FIG. 4, each terminal 5 comprises a tail portion 51 for engaging with a corresponding hole 90 of the PCB 9, a mounting portion 52 extending perpendicularly from one end of the tail portion 51, a curved spring arm 53 extending from a bottom end of the mounting portion 52, a V-shaped contacting portion 54 extending downwardly from a bottom end of the spring arm 53 for contacting with a mating FPC (not shown), and a preloading portion 55 extending horizontally from a free end of the contacting portion 54. The mounting portion 52 comprises two pairs of opposite barbs 521 extending perpendicularly from respective opposite edges thereof to securely retain the terminal 5 in the receiving groove 272.

Figure 5:
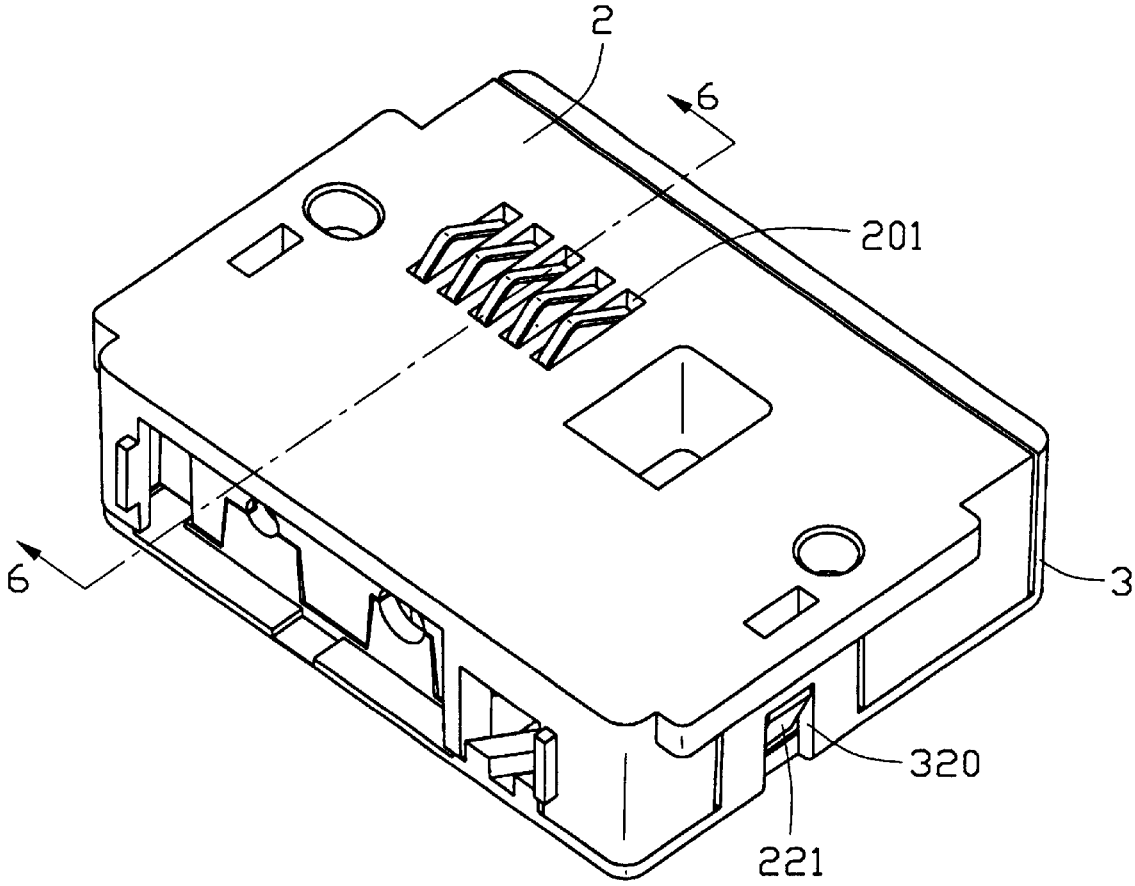
FIG. 5 is an assembled, bottom, perspective view of the compression connector, with fiber optical components, lens, filters and an LED removed for clarity.

Referring to FIGS. 1 and 5, in assembly, the terminals 5 are placed in the receiving grooves 272 with the barbs 521 interferentially received in the slots 273 to securely retain the terminals 5 in the receiving grooves 272. The contacting portions 54 project from the through holes 201 of the bottom wall 20 for electrically engaging with the FPC. The preloading portion 25 abuts against a ledge 28 of the bottom wall 20 of the base 2 to provide a preloading force, thereby enhancing the electrical connection between the terminal 5 and the FPC. Subsequently, the LED 4 and the fiber optical components 7 are respectively assembled in the first and second receiving rooms 25, 26. The lens 6 is placed in the first receiving channel 23 and then the filters 8 are placed in the second receiving channels 24. The PCB 9 is assembled at a rear portion of the bottom base 2. The tail portions 51 of the terminals 5, the fiber optical components 7 and the LED 4 are electrically connected to the PCB 9 by through hole soldering. Subsequently, the top cover 3 is assembled upon the bottom base 2, with the protrusions 221 of the bottom base 2 engaging with the slots 320 of the top cover 3. The PCB 9 is sandwiched between the bottom base 2 and the top cover 3 with the upper edge thereof being received in the receiving concavity 310.

Figure 6:
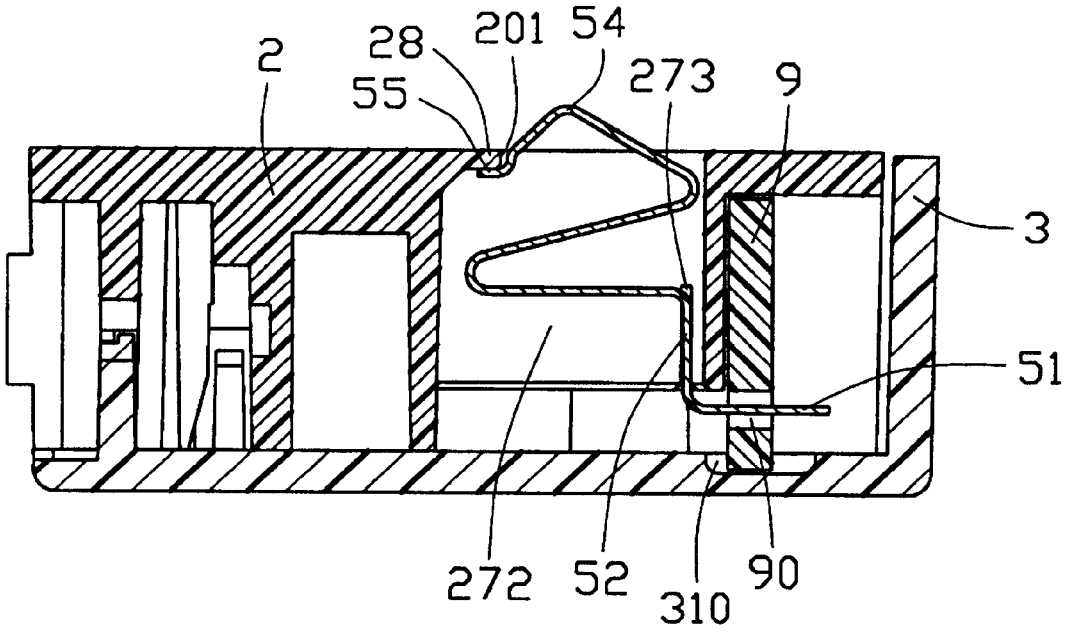
FIG. 6 is a cross-sectional view taken along line 6—6 in FIG. 5.

Referring to FIG. 6, the terminals 5 are received in the receiving grooves 272 of the terminal-receiving portion 27 of the bottom base 2. The tail portions 51 of the terminals 5 are welded into the holes 90 defined in the PCB 9 and the barbs 521 of the mounting portions 52 are interferentially received in the mounting slots 273. Therefore, the terminals 5 are securely retained in the receiving grooves 272.

It is to be understood, however, that even though numerous characteristics and advantages of the present invention have been set forth the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for mating with a flexible printed circuit board (FPC), comprising:

a bottom base comprising a terminal-receiving portion, the terminal-receiving portion comprising a plurality of block walls, a plurality of receiving grooves defined between the block walls, and a plurality of pairs of opposite mounting slots, each pair of opposite mounting slots being located on opposite sides of and in communication with a corresponding receiving groove;

a top cover assembled upon the bottom base;

a built-in printed circuit board (PCB) mounted perpendicularly between the top cover and the bottom base; and a plurality of terminals assembled in the bottom base, each terminal comprising a contacting portion outwardly projecting from the bottom base adapted for contacting the FPC, a mounting portion substantially received in the receiving groove, and a tail portion electrically connected with the PCB, the mounting portion comprising a pair of barbs interferentially engaged with a corresponding pair of opposite mounting slots to securely retain the terminal in the receiving groove; wherein the bottom base comprises a pair of side walls each having a protrusion, and the top cover comprises a pair of ears extending downwardly from two edges thereof, each ear defining a slot therein for engaging with a corresponding protrusion to retain the top cover on the bottom base; wherein the top cover defines a receiving concavity to receive an upper edge of the built-in PCB.

2. The electrical connector as described in claim 1, wherein each terminal further comprises a curved spring arm connecting the mounting portion with the contacting portion, the spring arm and the contacting portion together forming an "S" shape.

3. The electrical connector as described in claim 1, wherein each terminal further comprises a horizontal preloading portion extending from a free end of the contacting portion in a direction opposite to that of the tail portion.

4. The electrical connector as described in claim 3, wherein the bottom base comprises a ledge abutted against by the preloading portion of the terminal to provide a preloading force.

5. The electrical connector as described in claim 1, wherein the bottom base comprises a bottom wall, the bottom wall defining a plurality of through holes in communication with the receiving grooves for projection of the contacting portions of the terminals.

6. A terminal adapted for connecting a printed circuit board (PCB) and a flexible printed circuit board (FPC), comprising:

a horizontal tail portion adapted for engaging with the PCB;

a mounting portion extending perpendicularly and downwardly from an end of the tail portion, and comprising a pair of barbs extending perpendicularly from respective opposite edges thereof;

a curved spring arm extending from a bottom end of the mounting portion;

a V-shaped contacting portion extending from a bottom end of the spring arm adapted for engaging with the FPC; and a horizontal preloading portion extending from the contacting portion in a direction opposite to that of the horizontal tail portion;

wherein the curved spring arm and the V-shaped contacting portion together form an "S" shape.

* * * * *